US006721960B1

(12) United States Patent
Levesque et al.

(10) Patent No.: US 6,721,960 B1
(45) Date of Patent: Apr. 20, 2004

(54) BATTING GLOVE WITH INTERNAL PADDING

(75) Inventors: Robert Levesque, Portland, OR (US); Allan Schrock, Portland, OR (US); Charley Stobbs, Hillsboro, OR (US); Aaron Torres, Portland, OR (US); John Woodman, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 79 days.

(21) Appl. No.: 10/091,138

(22) Filed: Mar. 4, 2002

(51) Int. Cl.[7] ..... A41D 19/00
(52) U.S. Cl. ..... 2/161.1; 2/16
(58) Field of Search ..... 2/16, 20, 161.1–161.6, 2/160

(56) References Cited

U.S. PATENT DOCUMENTS 3,890,648 A * 6/1975 Beal ..... 2/20
4,624,016 A 11/1986 Luevano
4,864,660 A 9/1989 Sawyer
5,168,578 A 12/1992 Stanley
5,218,719 A 6/1993 Johnson
5,720,047 A * 2/1998 Spitzer ..... 2/161.1
5,790,980 A * 8/1998 Yewer, Jr. ..... 2/20
5,802,614 A * 9/1998 Melone, Jr. ..... 2/161.1
5,815,838 A 10/1998 Lord et al.
5,987,642 A 11/1999 Webster
6,427,246 B1 * 8/2002 Doi et al. ..... 2/161.1

* cited by examiner

*Primary Examiner*—Katherine Moran
(74) *Attorney, Agent, or Firm*—Banner & Witcoff, Ltd.

(57) ABSTRACT

A batting glove is disclosed, wherein the glove includes a base portion and a protective portion attached to the interior of the base portion and located between the base portion and a wearer's hand. The protective portion includes a material that attenuates impact forces and dampens vibrations associated with hitting a baseball or softball with a bat. Protection is achieved through placement of padding on the palmar surface of the joints connecting the phalanges with the metacarpals and on the palmar surface of the first, second and fifth digits. The shock-absorbing padding may be absent in areas of the palmar surface of the third and fourth digits.

12 Claims, 3 Drawing Sheets

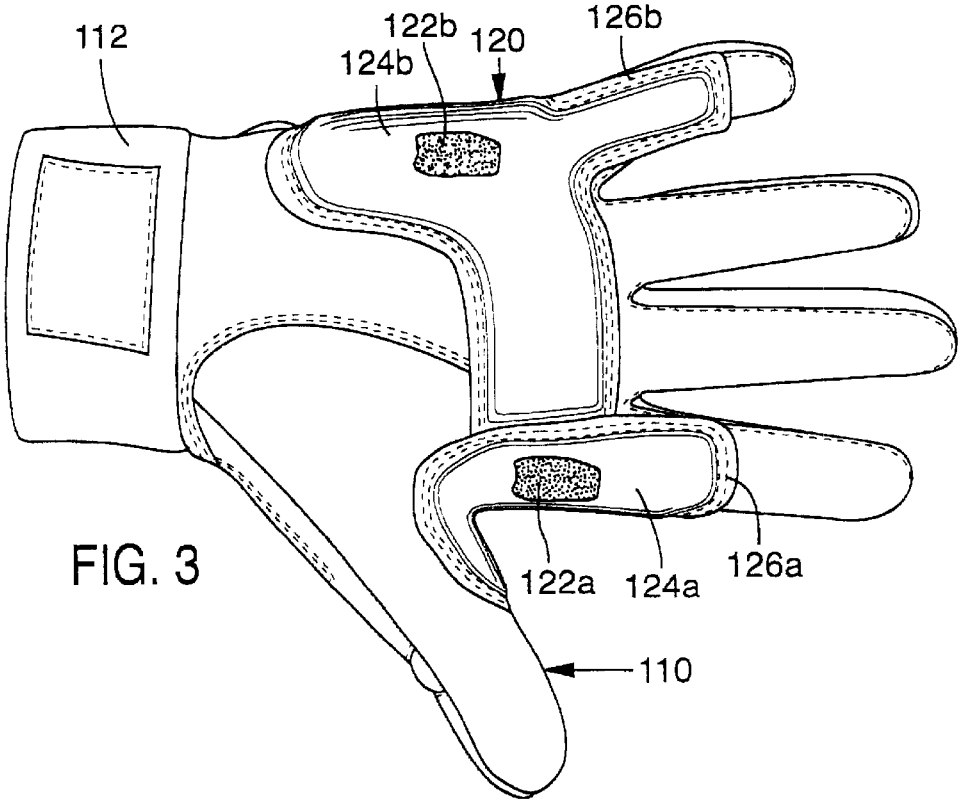
FIG. 3
FIG. 4
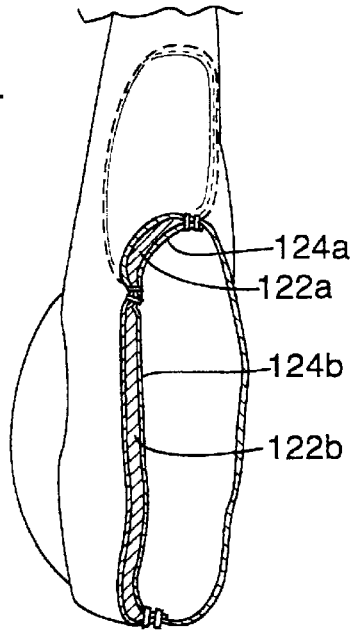

BATTING GLOVE WITH INTERNAL PADDING

BACKGROUND OF THE INVENTION

1. Field of the Invention

The present invention relates to an athletic glove for receiving and protecting the hand of a wearer. The invention concerns, more particularly, a batting glove for use by a baseball player, softball player, or the like.

2. Description of Background Art

Early batting gloves were thin, tight-fitting, leather gloves that served the dual purpose of improving grip on the bat and protecting the hand from shear forces associated with bat swing. Used in conjunction with a wooden bat, early batting gloves provided semi-effective hand protection because wood exhibits the capacity to attenuate impact forces and dampen vibrations that are generated when a bat contacts a ball.

In latter parts of the twentieth century, metal bats became prevalent among both amateur and professional athletes. Typically formed of aluminum or a specialized alloy, the metal bat did not exhibit the qualities of the wooden bat with respect to impact force attenuation and vibration dampening. As such, the hand absorbed a greater portion of the impact forces and vibrations associated with contacting a ball.

In response, batting glove manufacturers added a layer of thin padding to a portion of the exterior palmar surface of batting gloves. The padding served the dual purpose of attenuating impact forces and dampening vibrations. As a side effect, however, the padding often detracted from the batter's tactile sensation, thereby limiting control of the bat. In addition to a high degree of hand-eye coordination, the ability of the batter to perceive the position of the bat through tactile sensation and finely control bat motion based upon the tactile sensation is an important feature of batting. Accordingly, batting glove manufacturers have attempted to strategically place the padding so as to achieve a balance between protection and tactile sensation.

Manufacturers of batting gloves with various padding configurations include Nike, Easton, Franklin, Louisville Slugger, Markwort, Mizuno, Palmgard, Rawlings, Reebok, and Worth. In addition, patents relating to batting glove design include U.S. Pat. No. 5,987,642 to Webster; U.S. Pat. No. 5,168,578 to Stanley, and U.S. Pat. No. 5,218,719 to Johnson.

SUMMARY OF THE INVENTION

The present invention relates to a batting glove for receiving a hand of a wearer. The glove includes a base portion for covering at least a portion of the hand and a protective portion that is attached to the base portion and located between the base portion and the hand.

The primary design consideration behind the batting glove of the present invention is to protect to the hand from the impact forces and vibrations that are commonly associated with batting while retaining a high degree of tactile sensation in areas of the hand that are important to bat control. Protective padding that is placed in certain locations may detract from the ability of the batter to perceive the bat and properly grip the bat, thereby limiting control of the bat. Likewise, protective padding that is absent from other areas may expose the hand to greater levels of impact forces and vibrations. As such, the present invention balances the need for protection against the need for sensation with respect to each area of the hand surface that contacts the bat during batting.

Contact between a bat and a ball typically generates an oppositely-directed impact force that is primarily absorbed by the joints connecting the proximal phalanges with the metacarpals of the second through fifth digits. Contact between a bat and a ball may also generate vibrations that travel longitudinally along the length of the bat. The vibrations are typically dampened by the first, second and fifth digital areas. In order to protect the hand from impact forces and vibrations, padding is placed in at least the areas noted above.

The protective portion does not include padding on the third and fourth digital areas. Although these areas experience some impact forces and vibrations, the forces and vibrations are typically not significant enough to warrant protection. Furthermore, tactile sensation of the bat on the third and fourth digital areas improves bat control. As such, the need for retaining tactile sensation in these areas outweighs the lesser need for protection. Accordingly, the present invention serves the purpose of protecting areas of the hand that experience the majority of the forces and vibrations associated with batting while retaining tactile sensation in areas important to bat control.

Prior art batting gloves often utilized padding configurations wherein one side of the glove's palmar surface included substantially more padding than the other side. These configurations led to an unbalanced feeling when gripping the bat. Accordingly, the placement of padding on the second and fifth digits provides the batter with a more balanced grip and feel.

The advantages and features of novelty that characterize the present invention are pointed out with particularity in the appended claims. To gain an improved understanding of the advantages and features of novelty that characterize the present invention, however, reference may be made to the descriptive matter and accompanying drawings that describe and illustrate various embodiments of the invention.

BRIEF DESCRIPTION OF THE DRAWINGS

FIG. 3 is a third perspective view depicting the batting glove of FIG. 1 in an inside-out configuration.

FIG. 4 is a sectional view generally along line 4–4 of the batting glove depicted in FIG. 2.

DETAILED DESCRIPTION OF THE INVENTION

Referring to the accompanying figures, a batting glove in accordance with the present invention is disclosed. The figures illustrate only the glove intended for use on a left hand of a wearer. The invention also includes a right glove, such glove being the mirror image of the left. In distinguishing portions of the glove or the hand received by the glove, reference will be made to bones within the hand and wrist. Such references are not intended to demarcate precise areas. Rather, they are intended to delineate general areas to aid in the following discussion.

Figure 1:
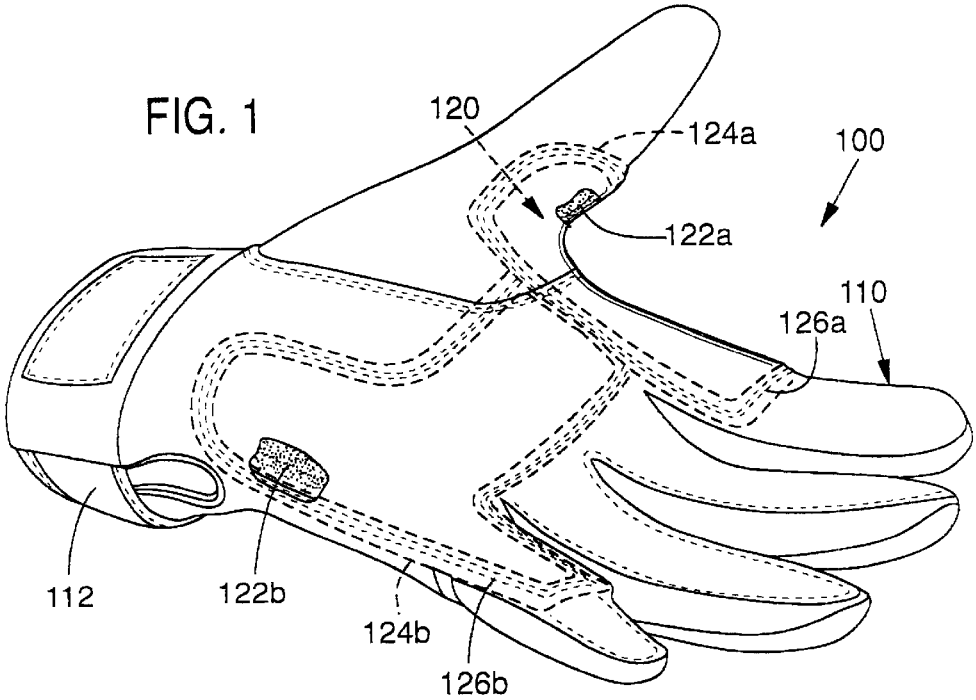
FIG. 1 is a first perspective view of the palmar surface of a batting glove according to the present invention.
Figure 2:
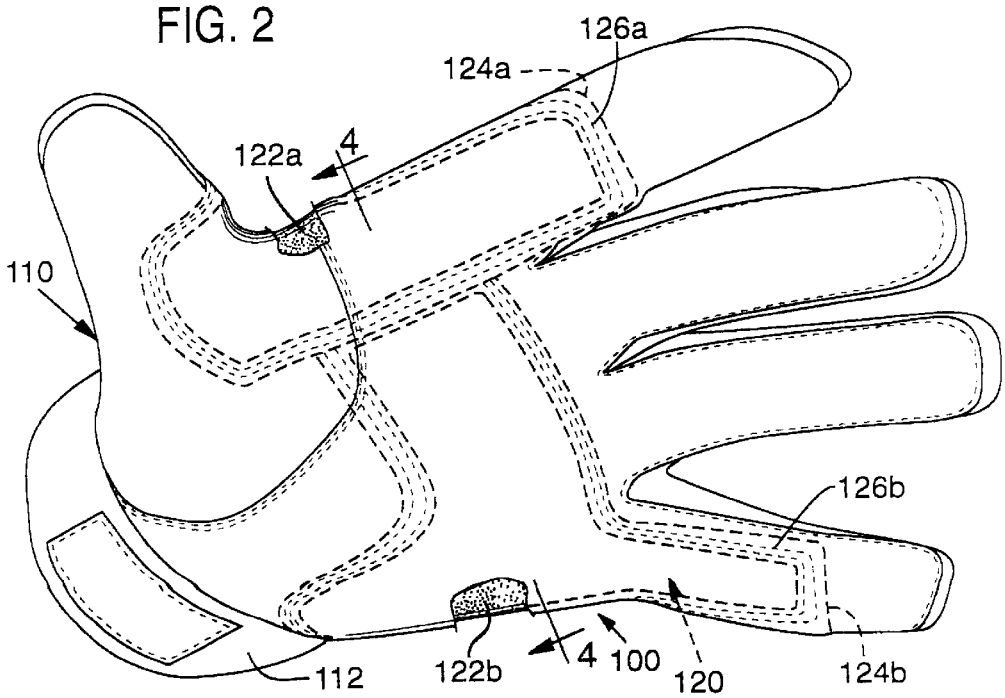
FIG. 2 is a second perspective view of the palmar surface of the batting glove depicted in FIG. 1.
Figure 5:
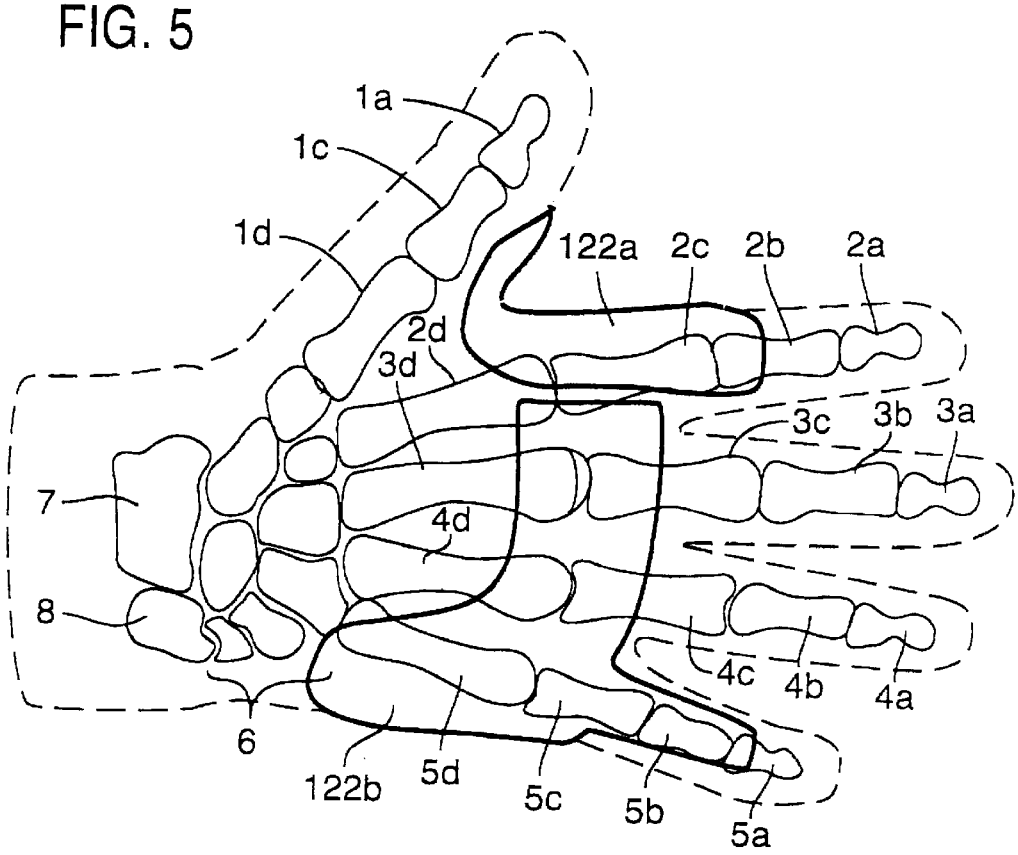
FIG. 5 is a schematic that depicts the relative location of foam pads and the bones of the hand.

The primary elements of glove 100, depicted in FIGS. 1–4, include a base portion 110 and a protective portion 120 located between base portion 110 and the hand of the wearer. Base portion 110 may be formed from one or more substrate materials that cover a portion of the hand, including the dorsal and palmar metacarpal areas; the sides of the hand; and the dorsal area, palmar area, and sides of the five digital areas, for example. Appropriate materials for base portion 110 include natural leather, synthetic leather, spandex, or other elastic polymer. A wrist strap 112, formed of an elastic material, may circumscribe the wrist area of base portion 110, thereby generally covering carpals 6 and the joints connecting radius 7 and ulna 8 with carpals 6. Wrist strap 112 may also include an adjustment strap to secure glove 100 to the hand of the wearer.

The protective portion of many prior art batting gloves is located on the exterior. That is, prior art batting gloves are configured such that the base portion is located between the hand and the protective portion. One advantage gained by configuring glove 100 to have protective portion 120 located between the hand and base portion 110 is that the bat contacts a smooth surface of glove 100, rather than a surface having multiple seams and elements of glove 10.

Protective portion 120 is primarily located on the palmar portion of glove 100 and includes two pads 122*a* and 122*b* and two corresponding coverings 124*a* and 124*b*. Pads 122 may be formed of a flexible, shock-absorbing material. In this regard, a suitable material is a conventional slow recovery polyurethane foam, alternately known as a memory foam, having a thickness of approximately three millimeters. Other materials that provide cushioning may also be utilized for pads 122.

Pad 122*a* covers an area of the palmar hand surface corresponding with the joint connecting second middle phalanx 2*b* with second proximal phalanx 2*c*; second proximal phalanx 2*c*; and the joint connecting second proximal phalanx 2*c* with second metacarpal 2*d*. In addition, pad 122*a* extends across the medial metacarpal area to cover first proximal phalanx 1*c* and the joint connecting first proximal phalanx 1*c* with first metacarpal 1*d*. Pad 122*b* covers areas of the palmar hand surface that include the joint connecting fifth distal phalanx 5*a* with fifth middle phalanx 5*b*; fifth middle phalanx 5*b*; fifth proximal phalanx 5*c*; the joints connecting proximal phalanges 3*c*, 4*c*, and 5*c* with metacarpals 3*d*, 4*d*, and 5*d*; and portions of fourth metacarpal 4*d* and fifth metacarpal 5*d*. In alternative embodiments, the area cooperatively covered by pads 122 may be covered by a single pad. Furthermore, the areas covered by pads 122 may cover less than the area disclosed above or extend to other portions of the hand.

Coverings 124 are located adjacent the hand and secure pads 122 to base portion 110. As depicted in FIG. 4, for example, coverings 124 extend beyond the edges of pads 122 and are sewn directly to base portion 110, thereby forming seams 126*a* and 126*b*. Accordingly, pads 122 are located between base portion 110 and coverings 124. Within the scope of the preset invention, other means for securing pads 122 may also be employed. Suitable materials for coverings 124 include leather, such as cabretta leather, or durable synthetic materials, such as vinyl, for example.

The configuration of protective portion 120, as disclosed above and in the figures, permits tactile sensation and bat control while having protective properties in areas that require impact force attenuation and vibration dampening. Pad 122*a* and the portion of pad 122*b* that corresponds with the fifth digit and fifth metacarpal 5*d* located on peripheral portions of the hand and are, therefore, positioned to absorb bat vibrations following contact between the bat and ball. In addition, the portions of pads 122 that correspond with the joints between proximal phalanges 2*c*, 3*c*, 4*c*, and 5*c* and metacarpals 2*d*, 3*d*, 4*d*, and 5*d*, respectively, protects the hand from the impact forces generated by a contact between the bat and ball. The absence of padding on the third and fourth digits permit a significant degree of tactile sensation in these areas.

The present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

What is claimed is:

1. A batting glove for receiving a hand of a wearer, said glove comprising:

a base portion for covering at least a portion of the hand, said base portion having an interior surface facing the hand and an exterior surface facing away from the hand; and a protective portion secured to said interior surface of said base portion and located between said base portion and a palmar area of the hand, said protective portion including:

a first section of a shock-absorbing material positioned to cover an area substantially limited to a joint between a second proximal phalanx and a second middle phalanx, and portions of a first digit, and a separate, second section of said shock-absorbing material positioned to cover an area substantially limited to joints between third, fourth, and fifth metacarpals and third, fourth, and fifth proximal phalanges, respectively, portions of a fifth digit, and portions of the fifth metacarpal.

2. The batting glove of claim 1, wherein a covering material extends over said shock-absorbing material and between said shock-absorbing material and the hand.

3. The batting glove of claim 1, wherein said shock-absorbing material is a slow recovery foam.

4. A batting glove for receiving a hand of a wearer, said glove comprising:

a base portion for covering at least a portion of the hand, said base portion having an interior surface facing the hand and an exterior surface facing away from the hand; and a protective portion attached to said interior surface of said base portion and located between said base portion and the palmar area of the hand, said protective portion including two separate sections of a shock-absorbing material that cover an area substantially limited to:

joints connecting second, third, fourth, and fifth metacarpals with second, third, fourth, and fifth proximal phalanges, respectively;

the second proximal phalanx and a joint connecting the second proximal phalanx with a second middle phalanx, and portions of a first digit and a fifth digit, and portions of the fifth metacarpal.

5. The batting glove of claim 4, wherein said protective portion includes a covering material located adjacent to the hand.

6. The batting glove of claim 4, wherein said shock-absorbing material is a slow recovery foam.

7. A batting glove for receiving a hand of a wearer, said glove comprising:

a base portion for covering at least a portion of the hand; and a protective portion secured to said base portion, said protective portion including:

a first section of a shock-absorbing material positioned to cover an area substantially limited to a joint between a second proximal phalanx and a second middle phalanx, and portions of a first digit, and a separate, second section of said shock-absorbing material positioned to cover an area substantially limited to joints between third, fourth, and fifth metacarpals and third, fourth, and fifth proximal phalanges, respectively, and portions of a fifth digit, and portions of the fifth metacarpal.

8. The batting glove of claim 7, wherein a covering material extends over said shock-absorbing material and between said shock-absorbing material and the hand.

9. The batting glove of claim 7, wherein said shock-absorbing material is a slow recovery foam.

10. A batting glove for receiving a hand of a wearer, said glove comprising:

a base portion for covering at least a portion of the hand; and a protective portion secured to said base portion, said protective portion including two separate sections of a shock-absorbing material that cover an area substantially limited to:

joints connecting second, third, fourth, and fifth metacarpals with second, third, fourth, and fifth proximal phalanges, respectively;

the second proximal phalanx and a joint connecting the second proximal phalanx with a second middle phalanx, and portions of a first digit and a fifth digit, and portions of the fifth metacarpal.

11. The batting glove of claim 10, wherein said protective portion includes a covering material located adjacent to the hand.

12. The batting glove of claim 10, wherein said shock-absorbing material is a slow recovery foam.

* * * * *